US005606875A

United States Patent [19]

Nishitani et al.

[11] Patent Number: 5,606,875

[45] Date of Patent: Mar. 4, 1997

[54] YARN LENGTH CONTROL SYSTEM FOR A FLAT KNITTING MACHINE

[75] Inventors: Hirokazu Nishitani, Arida; Yoshiyuki Komura, Wakayama, both of Japan

[73] Assignee: Shima Seiki Manufacturing Ltd., Wakayama, Japan

[21] Appl. No.: 588,718

[22] Filed: Jan. 19, 1996

[30] Foreign Application Priority Data

Jan. 23, 1995 [JP] Japan ..... 7-007943

[51] Int. Cl.[6] ..... D04B 15/36

[52] U.S. Cl. ..... 66/77; 66/54; 66/57; 66/71

[58] Field of Search ..... 66/54, 57, 60 R, 66/64, 132 R, 146, 203, 207, 71, 75.1, 77

[56] References Cited

U.S. PATENT DOCUMENTS

| | | | |
|---|---|---|---|
| 5,174,132 | 12/1992 | Bramdani | 66/54 |
| 5,174,133 | 12/1992 | Kawase et al. | 66/57 |
| 5,307,648 | 5/1994 | Forkert et al. | 66/207 |
| 5,311,751 | 5/1994 | Winter et al. | 66/207 |
| 5,311,752 | 5/1994 | Gille | 66/203 X |
| 5,331,564 | 7/1994 | Barea | 66/132 R X |
| 5,369,966 | 12/1994 | Morita et al. | 66/132 R |
| 5,442,564 | 8/1995 | Merlini et al. | 66/54 X |
| 5,473,913 | 12/1995 | Bogucki-Land | 66/204 X |
| 5,511,392 | 4/1996 | Sawazaki et al. | 66/54 |
| 5,511,394 | 4/1996 | Shima | 66/54 X |
| 5,515,701 | 5/1996 | Schubert | 66/204 |

FOREIGN PATENT DOCUMENTS

| | | |
|---|---|---|
| 0452800A1 | 10/1991 | European Pat. Off. . |
| 0489307A1 | 6/1992 | European Pat. Off. . |
| 0506322A1 | 9/1992 | European Pat. Off. . |
| 1585203 | 8/1963 | Germany . |
| 62-162054 | 7/1987 | Japan . |

OTHER PUBLICATIONS

Japanese Patent Office Patent Abstract of Japan 06025953, Jan. 1994.

(Derwent Publication No. 87–23900), Abstract Japan A–850.201.393 Jul. 1987.

(Derwent Publication No. 87–119308), Abstract Japan A–620 62977 Mar. 1987.

*Primary Examiner*—John J. Calvert

*Attorney, Agent, or Firm*—Nikaido, Marmelstein, Murray & Oram LLP

[57] ABSTRACT

In a flat knitting machine wherein a plurality of knitting locks work on a single needle bed to knit, the consumption of each yarn is measured and compared with the standard yarn length, and the stitch cam adjustment values of the respective knitting locks are corrected. The stitch cam adjustment data is stored for the respective combinations of stitch cams and yarns. Correction is not limited to the stitch cam which knitted the yarn of which consumption was measured. Correction by the same value is also given to the stitch cam adjustment values of other stitch cams relative to the yarn. As a result, for any combination of a stitch cam and a yarn which appears suddenly in the latter half of knitting, the stitch cam adjustment values have been corrected on the basis of the measurement of consumed yarn lengths of other stitch cams, generating no knitting gaps.

6 Claims, 5 Drawing Sheets

| | | KNIT. LOCK L | | KNIT. LOCK C | | KNIT. LOCK R | |
|---|---|---|---|---|---|---|---|
| | | CAM A | CAM B | CAM A | CAM B | CAM A | CAM B |
| COLOURED YARN | 1 | 0 | 0 | 0 | 0 | 0 | 0 |
| | 2 | +2 | +1 | 0 | 0 | +1 | −1 |
| | 3 | +2 | +2 | 0 | 0 | −1 | +1 |
| | 4 | 0 | 0 | 0 | 0 | 0 | 0 |
| | 5 | 0 | 0 | 0 | 0 | 0 | 0 |
| | 6 | 0 | 0 | 0 | 0 | 0 | 0 |
| | 7 | 0 | 0 | 0 | 0 | 0 | 0 |

YARN LENGTH CONTROL SYSTEM FOR A FLAT KNITTING MACHINE

FIELD OF THE INVENTION

The present invention relates to improvements of yarn length control systems for flat knitting machines.

PRIOR ART

The present applicant proposed yarn length control systems for flat knitting machines as disclosed in Provisional Japanese Patent Publication No. SHO-62-62977, Japanese Patent Publication No. HEI-1-49816 and Provisional Japanese Patent Publication No. HEI-6-25953. In Provisional Japanese Patent Publication No. SHO-62-622977, the standard yarn length LA for stitches of a specified number of courses is compared with the actual yarn length LB, and the stitch cam of the knitting machine is adjusted to bring the consumed yarn length close to the standard yarn length. In Patent Publication No. HEI-1-49816, the tension in the yarn is adjusted on the basis of a similar comparison. The variation in the consumed yarn length from the standard yarn length is fed back to the tension in the yarn rather than the stitch cam. In Provisional Patent Publication HEI-6-25953. a sample garment is knitted before the actual garment is knitted so as to compare the yarn length of the actual garment with that of the sample garment. In comparing yarn lengths, moving averages of yarn lengths over plural knitting courses are used, and stitch cams are adjusted so that the yarn length of the actual garment equals that of the sample garment.

Such a yarn length control brings the loop lengths of various parts of the garment close to the specified values. As a result, a garment of the desired size will be knitted, and fluctuations in loop size within one garment will be prevented.

Causes of variation in the loop length from the specified length are mainly related to yarns. For example, even when the stitch cam conditions are identical, if the material of the yarn, the dyestuff, the tension in the yarn, the diameter of the cone of the yarn, etc. vary, the loop length will vary. The second group of condition of variation in loop length is related to the flat knitting machine. For example, the knitting speed, the tension applied to the knitted fabric for lowering, etc. will vary the loop length. In addition to them, a change in temperature, humidity, etc. will vary the loop length. As the causes of variation in the loop length are mainly related to the yarns, even for the same stitch cam, if the kind of the yarn differs, the appropriate stitch cam adjustment value will differ. Hence the unit of adjustment of stitch cam is decided to be the pair of yarn and stitch cam or the combination of yarn and stitch cam. Stitch cam adjustment data is stored for every pair of yarn and stitch cam, and the stitch cam adjustment data is corrected for every pair on the basis of the comparison of the consumed yarn length and the standard one.

The present inventor, however, found the following problems as to the control of yarn length. For example, if one specific combination of yarn and stitch is used for the first time in the latter half of knitting of a garment, the stitch cam conditions for the specific combination will be the initial values. While for the other combinations of yarn and stitch cam, the stitch cam conditions have been controlled to bring the respective loop lengths to the desired values. As a result, the loop length will change sharply at a part in which the new combination of yarn and stitch cam is introduced, producing a knitting gap along the boundary of the preceding portion. Such a knitting gap is generated at a considerable frequency and is conspicuous. If such a knitting gap is generated, the value of the garment as merchandise will be lost. Such a problem may occur, for example, when a knitting lock differing from one which has been used previously is allocated to a yarn at the V-neck portion of a sweater. The conventional yarn length control methods can not overcome the problem of knitting gap, and in such a case, the garment design must be modified so that the allocation of knitting locks are not changed in the latter half of knitting.

There is a problem similar to the above-mentioned problem, the use of a new yarn in the latter half of knitting of a garment. In this case, as the yarn is used for the first time in the latter half of knitting of the garment, the stitch cam conditions are just those at the time of the start of knitting. Hence no correction has been made for changes in the conditions from the start of knitting till the start of the use of this yarn. As a result, knitting gaps will be generated at a considerable frequency. For the conventional yarn length control, knitting of a garment of such a design is virtually impossible. It is necessary to modify the design so that the specific yarn is used in the first half of knitting of the garment as well. Naturally, this is to avoid the use of a new yarn in the latter half of knitting.

All of these problems are attributed to that for a combination or some combinations of yarn and knitting lock no adjustment is made and knitting with the combination or the combinations is started with the conditions at the time of commencement of the knitting of the garment while for other combinations of yarn and knitting lock stitch cam adjustment data is constantly fed back. As the loop length of other yarns is control led, variations in the loop length of the specific combination or combinations become conspicuous, appearing as a knitting gap.

SUMMARY OF THE INVENTION

The objective of the present invention is to prevent the generation of any knitting gap by adjusting, in advance during knitting of preceding courses, the stitch cam of every pair of knitting lock and yarn which appears for the first time after a considerable number of courses since the start of knitting. The present invention particularly rests in that the stitch cam adjustment data for the specific pair of yarn and knitting lock is corrected without knitting with the specific pair, and this correction of the stitch cam adjustment data is made during knitting of preceding courses.

The present invention uses a flat knitting machine, wherein a plurality of yarns are fed from yarn feeding means to at least one needle bed, said needle bed is provided with a plurality of knitting locks, each knitting lock has a pair of an onward stitch cam and a rearward stitch cam, each knitting lock operates the needle bed to form series of stitches from the fed yarns, and the respective stitch cam conditions are corrected by the stitch cam adjustment data to alter the stitch size.

The yarn length control system of the present invention comprises:

a measuring means for measuring the consumption of each yarn;

a comparing means for comparing the measured consumption with the standard yarn length; and an adjusting means which generates correcting data for the stitch cam adjustment data according to the results of comparison by the comparing means and corrects, by the above-mentioned correcting data, at least one stitch cam of the knitting lock that operated the needle bed for the yarn of which consumption was measured, relative to the yarn, and is characterized in that said adjusting means corrects, by said correcting data, at least one stitch cam datum of one other knitting lock, relative to said yarn.

The measuring means mentioned above may be a means for measuring length, such as a rotary encoder provided on a side tension of the flat knitting machine; any means that can measure the yarn length will do. The standard yarn length may be, for example, one that is calculated from the specified yarn length per loop; the standard yard length is compared with the actual yarn length consumed, and the result is fed back to the stitch cam adjustment data to form stitches of the specified loop length. The correction of the stitch cam adjustment data is made for each pair of a yarn and a knitting lock, or preferably for each pair of a yarn and a stitch cam as a unit. The stitch cam adjustment is not limited to the yarn of which yarn length was measured and the knitting lock which involved in knitting of the yarn; the stitch cam adjustment data will be corrected, by the same value, for other knitting locks which relates to the yarn. There is no need of uniformly correcting the stitch cam adjustment data for all knitting locks. For example, if a certain knitting lock is not used for a certain yarn, there is no need of correcting the stitch cam adjustment data for that knitting lock. Moreover, when a specific yarn is used alternately by two knitting locks, there is no need of applying the correcting data, which was determined for one knitting lock, to the other knitting lock.

Preferably, when at least one stitch cam of a knitting lock which operated the above-mentioned needle bed and at least one stitch cam of said other knitting lock have the same direction for the onward/rearward movement and the stitch cam adjustment data is corrected for one stitch cam, the stitch cam adjustment data of the other stitch cam having the same direction is corrected. Here, preferably, a memory means for storing stitch cam adjustment data for each pair of a stitch cam and a yarn as a unit. When the flat knitting machine has one single carriage, the above-mentioned respective knitting-locks are contained in said carriage. In contrast, when the flat knitting machine has a plurality of carriages, the respective knitting locks may be separately contained in different carriages.

The present invention is also characterized in that in a yarn length control system for a flat knitting machine, wherein a plurality of yarns are fed from yarn feeding means to at least one needle bed, said needle bed is provided with a plurality of knitting locks, each knitting lock has a pair of an onward stitch cam and a rearward stitch cam, each knitting lock operates the needle bed to form series of stitches from the fed yarns, and the respective stitch cam conditions are corrected by the stitch cam adjustment data to alter the stitch size, said yarn length control system comprises:

a measuring means for measuring the consumption of each yarn;

a comparing means for comparing the measured consumption with the standard yarn length; and an adjusting means which generates correcting data for the stitch cam adjustment data according to the results of comparison by the comparing means and corrects, by the above-mentioned correcting data, at least one stitch cam of the knitting lock that operated the needle bed for the yarn of which consumption was measured, relative to the yarn, wherein said adjusting means corrects, by said correcting data, said stitch cam data of the knitting lock which operated the needle bed for the yarn of which consumption was measured, relative to other yarns.

In the present invention, correction data for the stitch cam adjustment data determined for a combination of a yarn and a knitting lock is also applied to adjustment of other knitting locks relative to the specific yarn. For example, suppose a combination of a yarn 1 and a knitting lock 1 is used to knit a fairly large number of courses, then a different combination of the yarn 1 and a knitting lock 2 is used. In the conventional control cases, the stitch cam adjustment data for the combination of the yarn 1 and the knitting lock 2 remains the same as the one at the start of knitting; changes in the conditions after the start of knitting are neglected. As a result, when the knitting is started by the new combination, the loop length will deviate from the specified value, generating a knitting gap. In the present invention, however, when knitting is carried out by the combination of the yarn 1 and the knitting lock 1, the stitch cam adjustment data is also changed for the combination of the yarn 1 and the knitting lock 2. Hence a sudden use of the combination of the yarn 1 and the knitting lock 2 will not generate a knitting gap. This in turn will increase the degree of freedom of designing a garment, enabling knitting of designs which were impossible in the past.

Each knitting lock has two stitch cams; one onward stitch cam and one rearward stitch cam. Preferably, separate stitch cam adjustment data are corrected for the onward stitch cam and the rearward stitch cam, respectively. When the stitch cam adjustment data is corrected relative to the yarn 1 and the onward stitch cam of the knitting lock 1, the stitch cam adjustment data are also corrected relative to the same yarns 1 and the onward stitch cams of other knitting locks. For this purpose, it is desirable to measure separately the consumed yarn length in the onward direction and the consumed yarn length in the rearward direction. In the onward direction and in the rearward direction, the directions of the tension applied by the yarn feeding means are opposite to each other, relative to the direction of motion of the knitting lock. For example, when the loop length shifts away from the specified value due to tension variation, it may be necessary to correct the stitch cam adjustment data so that the loop length is increased for the onward direction while it may be necessary to correct the stitch cam adjustment data so that the loop length is decreased for the rearward direction. To handle these cases, it is preferable to correct the stitch cam adjustment data separately for the onward direction and for the rearward direction.

There may be a design wherein a certain yarn is used suddenly in the latter half of knitting of a garment. In the conventional cases, the stitch cam adjustment data for this yarn are just the same conditions as those at the time of the initial start of knitting, and knitting gaps will be generated. However, if the correcting data for the stitch cam adjustment data for a certain knitting lock and a certain yarn are applied for one other yarn which is involved with the knitting lock, no knitting gap will be generated. Thus relative to the yarn to be used only in the latter half of the knitting, the stitch cam adjustment data has been corrected for changes in knitting conditions. In this way, the loop length is prevented from changing suddenly. As a result, such a design becomes feasible.

EMBODIMENT

Figure 1:
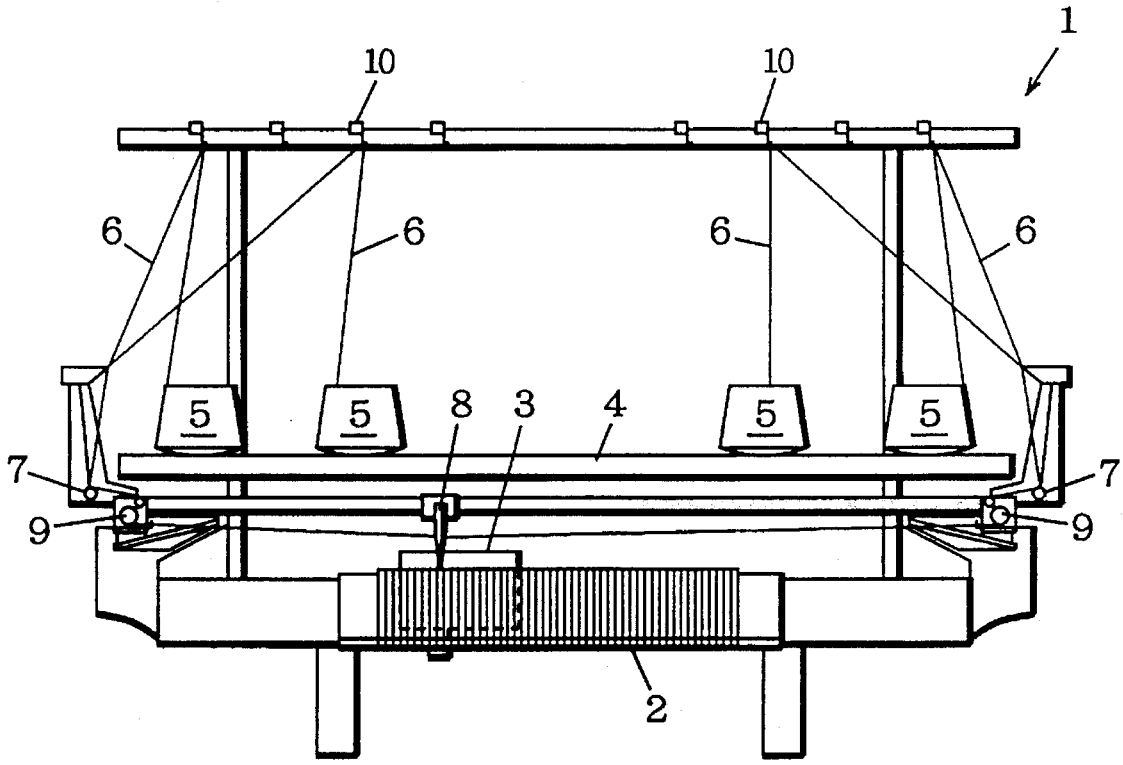
FIG. 1 is a front view of a flat knitting machine used in the embodiment.

In the following, one embodiment of the present invention will be described with reference to the attached drawings. FIG. 1 is a front view of a flat knitting machine 1. The flat knitting machine 1 is provided with, for example, a pair of needle beds, one in the front and one in the rear, with their fronts being opposed to each other. Said needle beds 2 support a large number of knitting needles in such a way that the needles can be freely moved forward and backward. On the needle beds 2, a carriage 3 for controlling forward and backward movements of the knitting needles is slidably arranged. The respective yarns 6 are fed from a plurality of cones 5 on the frame 4 of the flat knitting machine 1 to the knitting needles of the needle beds 2 via the top tensions 10, the side tensions 7 provided on both sides of the knitting machine, and the yarn feeders 8 which reciprocate in synchronization with the travel of the carriage 3. The side tensions 7 are provided with yarn length detectors 9 such as rotary encoders for the respective yarns; thus the consumed yarn length of each yarn is detected for, for example, every knitting course.

Figure 2:
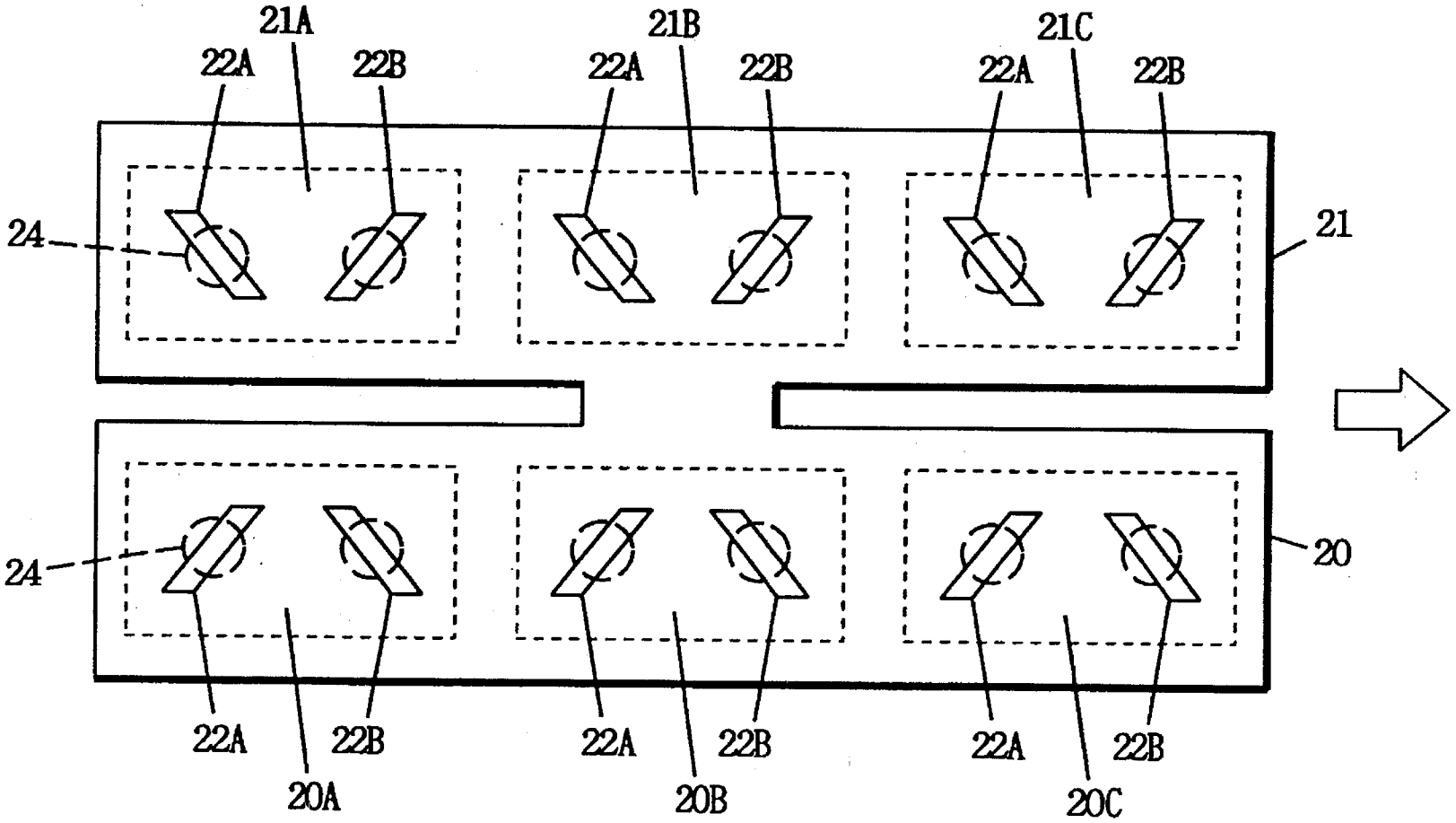
FIG. 2 is a diagram showing the layout of stitch cams in the carriage.

FIG. 2 shows a carriage 3 used in the embodiment. The carriage 3 has a front carriage 20 corresponding to the front bed and a rear carriage 21 corresponding to the rear bed. The front and rear carriages 20, 21 have three knitting locks (20A, 20B, 20C), (21A, 21B, 21C), respectively. For simplicity, the knitting locks on the left side are called knitting locks L. The knitting locks in the middle are called knitting locks C. The knitting locks on the right side are called knitting locks R. Each knitting lock is provided with a stitch cam 22A which operates in the onward movement (from the left to the right in the diagram) and a stitch cam 22B which operates in the rearward movement (from the right to the left). Each stitch cam 22A or 22B is provided with a stitch cam adjustment motor 24 which adjusts the stitch cam value. The stitch cam adjustment motor 24 adjusts the stitch cam value or the height of the stitch cam 22A or 22B when the direction of travel of the carriage 3 is reversed.

Figure 3:
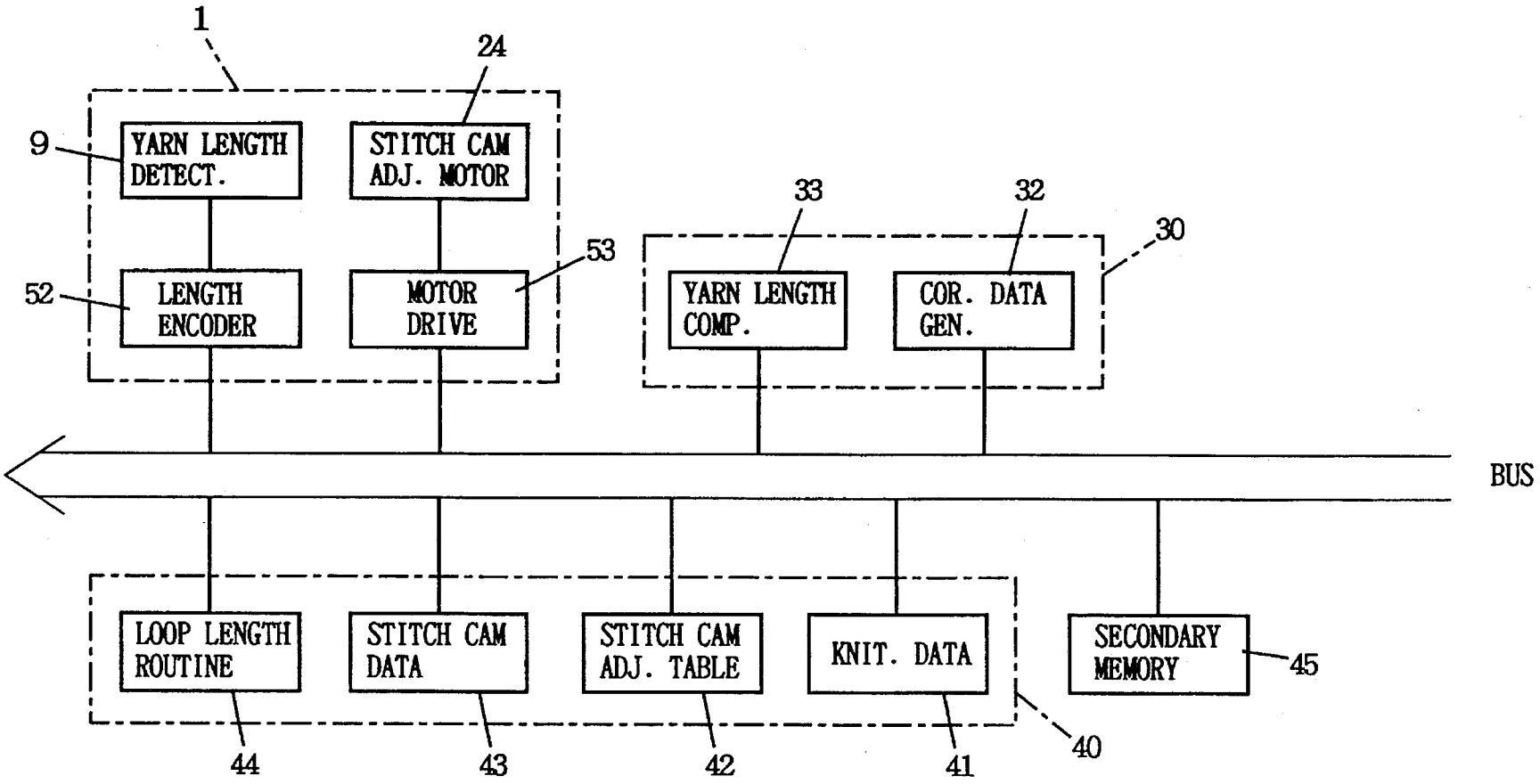
FIG. 3 is a block diagram of the yarn length control system of the embodiment.

FIG. 3 shows the yarn length control system of the embodiment. 30 is a control block which uses, for example, a microcomputer to control the entirety of the yarn length control system. The control block 30 is provided with a correction data generator 32 which generates correction data of stitch cam values and a yarn length comparator 33 which compares the consumed yarn length with the standard yarn length. 40 is a memory 40 which stores various data and programs. A knitting data memory 41 stores knitting data comprising knitting patterns, various control data, loop length, etc. inputted from a secondary memory 45 such as a floppy disc.

Figures 4, 5:
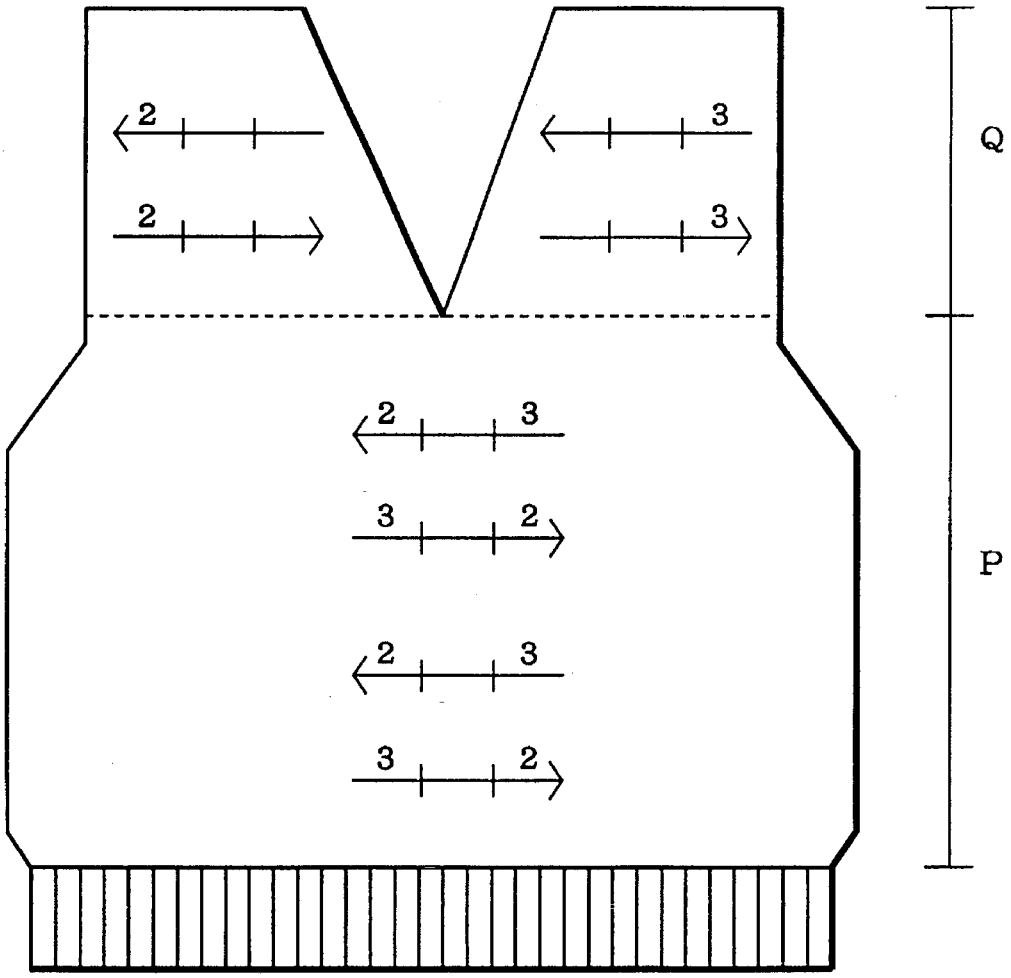
FIG. 4 is a diagram showing a stitch cam adjustment table stored in a memory block.
FIG. 5 is a diagram showing assignment of the yarns to the knitting locks for knitting a garment.

42 is a stitch cam adjustment table which stores stitch cam adjustment data for the respective stitch cams 22A, 22B. The stitch cam adjustment table 42 stores the stitch cam adjustment data for each stitch cam in the form of a pair of the stitch cam and a yarn, and stores such data for, for example, single, double and triple knitting, respectively. Single, double and triple indicates the number of knitting courses knitted at a time. For example, the area Q of FIG. 5 is of single knitting, and the area P is of double knitting. Hence the total number of stitch cam adjustment values to be stored for one stitch cam is the number of yarns to be used ×3 (single, double, triple). These stitch cam adjustment values are stored separately for every stitch cam. For example, the stitch cam adjustment values for the stitch cam 22A of the knitting lock 20A are stored separately from those for the stitch cam 22A of the knitting lock 21A. In the embodiment, the data of stitch cam adjustment values of the front carriage 20 and the data of stitch cam adjustment values of the rear carriage 21 are common to each other. The configuration of the stitch cam adjustment table itself is discretionary.

FIG. 4 shows an example of the stitch cam adjustment table 42. It indicates areas where data is present, neglecting the distinction between single and double. When the stitch cam adjustment value is 0, it is a default value and indicates data is not present in FIG. 4. In FIG. 4, the second and third yarn feeders are used, and the knitting lock C is not used. Hence the stitch cam adjustment values are stored for the combinations of the knitting locks L. R and the second and third yarn feeders.

The knitting data specify the loop lengths of the respective courses. The specified loop lengths are converted into stitch cam values and stored in the stitch cam data-memory 43. These stitch cam values are free of any adjustment. When the stitch cam adjustment values are added to them, the actual stitch cam values is obtained. 44 is a memory which stores a loop length routine program. This routine is executed before the actual knitting of a garment. The specified standard yarn length and the actually consumed yarn length are compared, for example for each course, by the yarn length comparator 33. The correction data generator 32 corrects the stitch cam adjustment values so that the consumed yarn length equals the standard yarn length with a precision of, for example, ±1%. The stitch cam adjustment values at the time of completion of the loop length routine are the initial values of the stitch cam adjustment table. The loop length routine requests the user to specify the desired combinations of yarns (actually yarn feeders 8) and knitting locks to be used together with the knitting types, single, double and triple. The routine is executed for the specified combinations. The knitting data may be read by the control block 30 prior to the execution of the loop length routine to determine the combinations of yarn feeders 8 and knitting locks to be used. Then the loop length routine can be done for the combinations thus determined.

A yarn length detector 9 outputs the yarn length of a yarn 6 fed by a yarn feeder 8 as a number of pulses. The yarn length encoder 52 converts the number of pulses into a consumed yarn length and inputs the consumed yarn length into the yarn length comparator 33. The yarn length comparator 33 compares the consumed yarn length with the standard yarn length based on the loop length contained in the knitting data. The correction data generator 32 corrects the stitch cam adjustment values according to the results of comparison. For simplicity, we assume that the knitting data specify a constant loop length, and ignore the stitch cam data memory 43. On the basis of the correction of the stitch cam adjustment values, the motor drive 53 controls the stitch cam adjustment motors 24 to adjust the heights of the respective stitch cams 22A, 22B.

In the course of knitting, the yarn length comparator 33 compares the standard yarn length and the consumed yarn length for, for example, every course. Then according to the difference between them, the correction data generator 32 corrects the stitch cam adjustment value by a unit of, for example, ±1. The correction of the stitch cam adjustment table 42 is made for a plurality of stitch cams relative to one yarn feeder 8 as a unit. A yarn feeder 8 has one to one correspondence to a yarn. Assume, for example, that as a result of the yarn length measurement it is necessary to correct the stitch cam adjustment values by +1 for the combination of the onward stitch cam 22A of the knitting lock L of the front carriage 20 and the second yarn feeder. In FIG. 4, this correcting value +1 is also applied to the combination of the stitch cam 22A of the knitting lock L of the rear carriage 21 and the second yarn feeder. The same correcting value is also applied to the onward stitch cams 22A of the knitting locks R, irrespective of the front carrier 20 and the rear carrier 31. The reason of applying the result at the knitting lock L to the knitting lock R only is that the knitting lock R alone uses the second yarn feeder among other knitting locks. Every stitch cam of the front carriage 20 and the stitch cam in the corresponding position of the rear carriage 21 share common stitch cam adjustment value for the same yarn.

The stitch cam adjustment values of the six onward stitch cams 22A may be uniformly adjusted by +1 relative to the second yarn feeder, irrespective of the front carriage 20 and the rear carriage 21 of FIG. 2. The scope of correction may be limited to the three onward stitch cams 22A of the front carriage 20; thus the front carriage 20 and the rear carriage 21 may be treated separately. Moreover, all the 12 stitch cams 22A, 22B may be uniformly corrected by +1 at a time relative to the yarn feeder 2, irrespective of the onward and rearward types.

When the yarn feeder 2 is used on the onward side, the yarn feeder 2 may be used in many cases on the rearward side for some preceding or following courses. In such a case, the measurement of the consumed yarn length for a rearward course gives correcting values of the stitch cam adjustment values. Hence there is no need of applying the correcting values for stitch cam adjustment values determined for the onward side to the stitch cams 22B on the rearward side. Moreover, when the tension in the yarn is increased, if we assume that the yarn is fed from the left of FIG. 1, the loop length will be decreased on the onward side, and the loop length will be increased on the rearward side. Hence in such a case, the stitch cam adjustment values on the onward side must be corrected in a direction opposite to those on the rearward side. It, therefore, is desirable to update the stitch cam adjustment values of the onward stitch cams 22A independently of those of the rearward stitch cams 22B. It should be noted that the initial values of the stitch cam adjustment values determined by the loop length routine vary from stitch cam to stitch cam. Hence the stitch cam adjustment values are varied, reflecting the differences of their initial values.

The control of the stitch cam adjustment values does not necessarily require the use of the stitch cam adjustment table 42 of FIG. 4. For example, the stitch cam adjustment table 42 may store the initial values of the stitch cam adjustment values obtained by the loop length routine. Then the correcting values for the stitch cam adjustment values are stored for the onward stitch cams and the rearward stitch cams, respectively, relative to each yarn feeder as a unit. When these data are added to the data of the stitch cam adjustment table, we will obtain the same stitch cam adjustment values as those of FIG. 4.

A case of knitting, for example, a V-necked sweater by using the above-mentioned embodiment will be described. FIG. 5 shows the relationship between the yarn (yarn feeder number) and the knitting lock when the front body of the V-necked sweater is knitted. A mark P indicates an area from the end of the bottom rib to the V-neck formation portion (not inclusive). In this area, the left and right knitting locks R, L are used to make double knitting. The leading knitting lock (R when travelling to the right, and L when travelling to the left) uses the yarn 2. The trailing knitting lock (L when travelling to the right, and R when travelling to the left) uses the yarn 3. The knitting locks to be used for the respective yarns are switched over at the every turn of the knitting direction. For example, the knitting lock R uses the second yarn feeder during onward travelling (travelling to the right), and the knitting lock L uses the second yarn feeder during rearward travelling (travelling to the left). As double knitting is used, two courses of stitches are formed in the body for every traverse of the carriage. The V-neck formation area Q is of single knitting. The knitting lock L and the yarn 2 are used for the right half portion, and the knitting lock R and the yarn 3 are used for the left half portion. In the area Q, the same knitting lock is assigned to one yarn for both the rightward and leftward movements, and one course of stitches on the left and one course of stitches on the right of the neck are formed by every traverse of the carriage. In FIG. 5, the front body of the sweater is seen from your side. Thus the right half portion of the sweater is shown on the left of the diagram.

Figure 6:
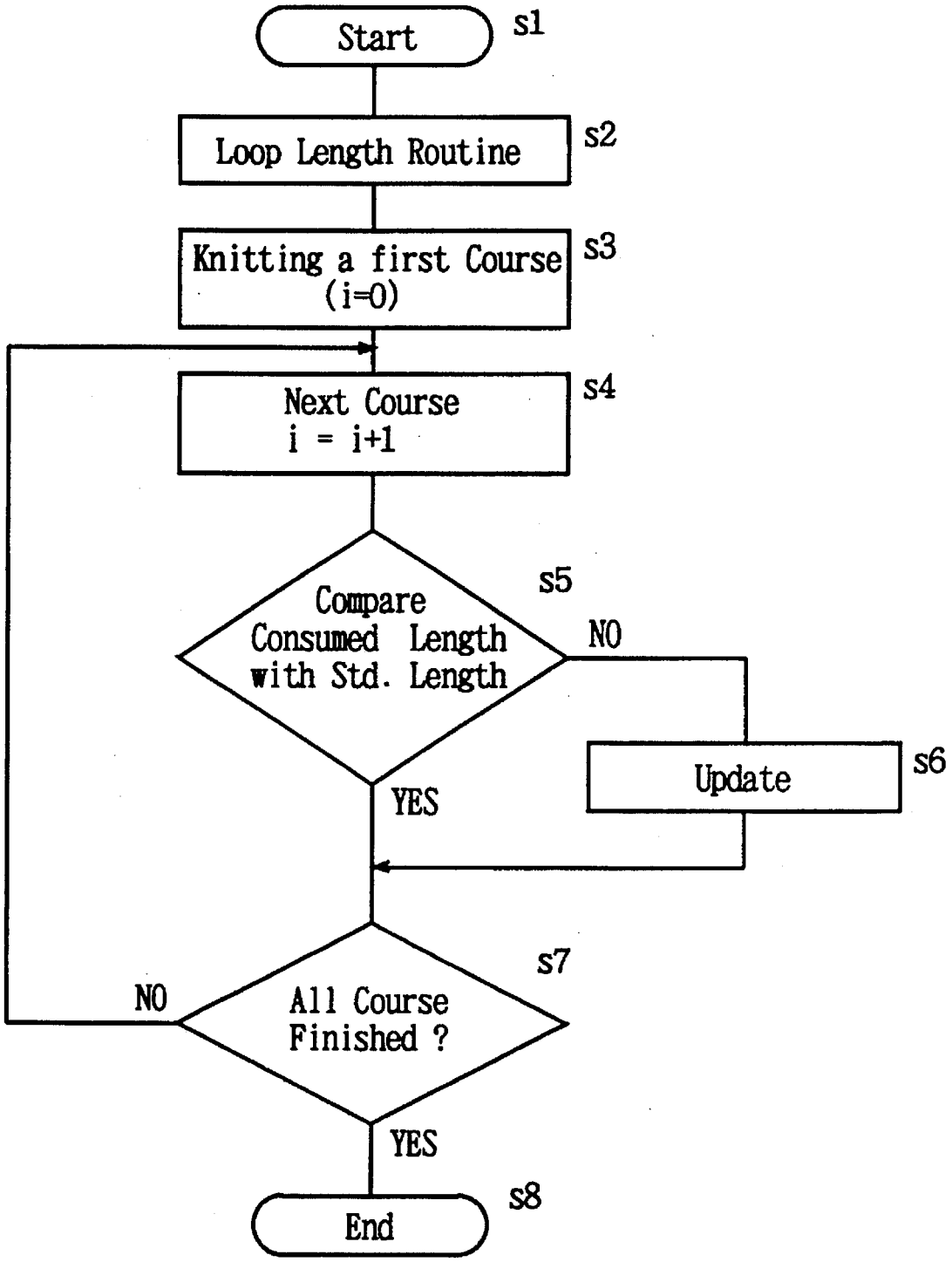
FIG. 6 is a flow chart showing the control of yarn length in the embodiment.

FIG. 6 shows the processes of knitting the above-mentioned garment. In Step 1, the process starts. For example, the user specifies the combinations of yarn feeders and knitting locks to be used. In Step 2, prior to knitting the actual garment (V-necked sweater), the loop length routine is executed. In this routine, yarns to be used for the garment are used to determine stitch cam adjustment values for producing loops of the specified loop lengths. In the example of FIG. 5, stitch cam adjustment is made for the knitting lock R (for rightward movement) and the knitting lock L (for leftward movement) relative to the yarn 2 and for the knitting lock L (for rightward movement) and the knitting lock R (for leftward movement) relative to the yarn 3 for double knitting. The initial values of stitch cam adjustment values are determined to obtain the desired loop lengths, and these initial values are stored in the columns of double knitting of the stitch cam adjustment table 42. In a similar manner, stitch cam adjustment is made, in single knitting, for the knitting lock L (both the rightward and leftward movements) relative to the yarn 2, and for the knitting lock R (both the rightward and leftward movements) relative to the yarn 3. The stitch cam adjustment values thus determined by single knitting are stored in the columns of single knitting of the stitch cam adjustment table 42. The stitch cam adjustment values are determined by distinguishing the onward stitch cams and the rearward stitch cams, namely, 22A and 22B, and the consumed yarn lengths are measured for the onward side and the rearward side, respectively. The stitch cam adjustment values relative to other yarns and the stitch cam adjustment values for the knitting lock C remain to be zero, default-value. To economize the consumption of the yarns in the loop length routine, the loop length routine may be executed for a part of combinations of the yarns and the stitch cams to be used. For the remaining combinations, appropriate values may be estimated from the stitch cam adjustment values determined by the loop length routine.

In Step 3, the stitch cam adjustment values of the respective combinations of yarns and stitch cams are used to knit an actual garment. i in FIG. 6 indicates the course number, and i=0 is the initial value. For example, when one course is knitted, the course number i will be incremented by 1 (Step 4). The consumed yarn length of the course and the standard yarn length are compared with each other (Step 5). If the difference is not within a specified range, the correction data generator 32 update the stitch cam adjustment values (Step 6). For example, the yarn length of the yarn 2 consumed by the knitting lock R (stitch cam 22A) is measured in the rightward knitting course and compared with the standard yarn length. If the difference is not within the specified range, the stitch cam adjustment value is corrected by +1 or −1.

This correction is given to the stitch cam adjustment value of the stitch cam 22A of the knitting lock R in the double knitting column of the stitch cam adjustment table 42, and to the stitch cam adjustment value of the stitch cam 22A of the knitting lock L in the single knitting column of the table 42. If there are any other combinations of the yarn 2 and the stitch cam 22A or 22B, the same correction is given to their stitch cam adjustment values. In a similar manner, the stitch cam adjustment values on the leftward side relative to the yarn 2 are corrected. For example, on the basis of the consumed yarn length (double) of the stitch cam 22B of the knitting lock L in the area P, the stitch cam adjustment value of the stitch cam 22B (double and single) of the knitting lock L is corrected. Similar correction of stitch cam adjustment values is given relative to the yarn 3. On the basis of the consumed yarn length (double) of the stitch cam 22A of the knitting lock L in the area P, the stitch cam adjustment value of the stitch cam 22A of the knitting lock L for double knitting and the stitch cam adjustment value of the stitch cam 22A of the knitting lock R for single knitting are corrected. Moreover, on the basis of the consumed yarn length of the stitch cam 22B (double) of the knitting lock R in the area P, the stitch cam adjustment value of the stitch cam 22B (double and single) of the knitting lock R is corrected. As a result of these operations, during the knitting of the area P of FIG. 5, the stitch cam adjustment values are corrected for knitting of the area Q.

In the V-neck area Q, the yarn 2 is processed by the knitting lock L in both the rightward and leftward movements. Of these movements, the leftward movement is identical to that in the area P, except the difference between single and double knitting. Hence for this portion, the correction may be given by the same values to the stitch cam adjustment values by ignoring the difference between single knitting and double knitting. A problem here is that the knitting lock L is used for the rightward movement in the area Q whereas the knitting lock R is used for the rightward movement in the area P. In the embodiment, correction to the stitch cam adjustment value is given relative to the use of the knitting lock L for the rightward movement in the area Q according to the result of the use of the knitting lock R for the rightward movement in the area P. As a result, the effects of various factors of fluctuation for the period from the start of the knitting till the arrival at the area Q have already been processed. Hence when the knitting lock L uses the yarn 2 to knit in the rightward direction in the area Q, no knitting gap will be generated because of the loop length differing from other portions. The conventional methods generate a knitting gap along the boundary between the area P and the area Q since for the rightward knitting of the yarn 2 for example, the stitch cam adjustment value at the time of execution of loop length routine is effective in the area Q, and changes in the knitting conditions in the area P, etc. are not considered at all. This also applies to the yarn 3. The results of knitting by the knitting lock L in the area P are fed back to the knitting ,lock R for the area Q; the loop length of the stitches of the rightward knitting of the yarn 3 will not change abruptly at the start of the area Q.

It should be noted that the design of FIG. 5 is one that can not be knitted by the conventional yarn length control. The use of any conventional methods will generate knitting gaps at a considerable frequency. The inventor has confirmed by the embodiment that generation of knitting gaps along the boundary of the area P and the area Q of the design of FIG. 5 can be prevented. Moreover, the inventor also has confirmed that when assignment of knitting locks for the yarns 2 and 3 is frequently alternated in the area P, for example, in a design for which the knitting locks R, L are alternately used for rightward knitting of the yarn 2, the embodiment can make satisfactory knitting without any troubles such as oscillation of the stitch cam adjustment values.

The correction of stitch cam adjustment values is made similarly in the area Q. The correcting value for the stitch cam 22A obtained by the knitting lock L relative to the yarn 2 is substituted to the column of the stitch cam 22A of the knitting lock R. Similarly, a correcting value for the stitch cam 22B obtained by the knitting lock L is substituted to the column of the stitch cam 22B of the knitting lock R, etc. Moreover, When a correction is made to stitch cam adjustment data of any one of the types single, double and triple, a correction is also given to the stitch cam adjustment values of the same stitch cams of other types relative to the same yarn. In the embodiment, the front and rear carriages 20, 21 have the common stitch cam adjustment values.

Step 7 checks whether all the course of knitting the garment are completed. If there is a subsequent knitting course or courses, it returns to Step 4 to continue knitting. When it is confirmed by Step 7 that all courses are completed, it moves to Step 8 to complete knitting of the garment.

In the following, a second embodiment will be described. For this embodiment, it is desirable to use a flat knitting machine which is provided with a buffer such as a well-known yarn retainer between a cone and a yarn feeder so that knitting can be made by keeping the tensions in the respective yarns constant during knitting. The garment to be knitted in the present embodiment is identical to that of FIG. 5 except a yarn 4 is used for the right body and a yarn 5 is used for the left body in the knitting area Q. The knitting procedures are identical to those of FIG. 6 except Step 6 has been changed. In Step 1, the process starts. In Step 2, prior to knitting an actual garment, the loop length routine 44 is executed to determine stitch cam adjustment data for the respective stitch cams of the respective knitting locks relative to the respective yarns. Next, in Step 3, the stitch cam adjustment values relative to the respective yarns obtained above are used to start knitting an actual garment (i=0 at this time, and i indicates the knitting course). In Step 4, the (i+1)th course is knitted, and the consumed yarn length of the yarn for a specified range is measured for each knitting lock by the yarn length detector. In Step 5, the yarn length comparator 33 compares the consumed yarn length with the standard yarn length, and if the difference is outside the specified range, the correction data generator 32 updates the stitch cam adjustment value in Step 6.

In the rightward knitting courses, the yarn length of the yarn 2 consumed by the knitting lock R (stitch cam 22A) is compared with the standard yarn length, and if the difference is outside the specified range, the stitch cam adjustment value is corrected by +1 or −1. The newly obtained adjustment value is added to the adjustment value of the stitch cam 22A of the knitting lock R stored in the stitch cam adjustment table 42 so as to update the adjustment value. At the same time, the newly obtained adjustment stitch cam adjustment value is added to the adjustment value of the stitch cam of the same direction relative to the yarn 5 (the stitch cam 22A of the knitting lock R) so as to update the adjustment value. Similarly, the stitch cam adjustment value of the stitch cam 22A of the knitting lock L relative to the yarn 3 is updated, and at the same time, the stitch cam adjustment value of the stitch cam 22A of the knitting lock L relative to the yarn 4 is corrected by the same value.

In the leftward knitting courses, the updating of the stitch cam adjustment values is similar to that in the rightward knitting courses. The correcting value for the stitch cam adjustment value obtained by the stitch cam 22B of the knitting lock L relative to the yarn 2 is applied to the same stitch cam 22B of the same knitting lock L relative to the yarn 4. Similarly, the correcting value for the stitch cam adjustment value obtained by the stitch cam 22B of the knitting lock R relative to the yarn 3 is applied to the same stitch cam 22B of the same knitting lock R relative to the yarn 5.

If the stitch cam adjustment values are updated in the above-mentioned manner, when the V-neck formation area Q is knitted, the stitch cam adjustment values of the knitting lock L relative to the yarn 4 and the stitch cam adjustment values of the knitting lock R relative to the yarn 5 have been updated in the knitting area P. Hence at the time of switchover from the area P to the area Q the stitch cam adjustment values stored at the time of execution of the loop length routine do not work as is the case of the conventional methods, and knitting is continued under the current knitting parameters. As a result, generation of any knitting gaps can be prevented. Subsequent Step 7 and Step 8 are processed similarly to the first embodiment.

Preferable embodiments of the present invention have been described. It should be noted, however, that the present invention are not limited in any way to the embodiments. For instance, measurement of the yarn length may be done for every plural courses rather than for every single course. The method of measuring the yarn length itself is discretionary. What is preferred with regard to the measurement of the yarn length is separate measurement of the onward side and the rearward side and separate correction of the stitch cam adjustment values of the onward side and the rearward side. In the embodiments, the case of a single carriage 3 is shown, but a plurality of carriages may be provided on the needle beds. In this case, three carriages may be used in correspondence with the knitting locks L, C and R, or two carriages in correspondence with the knitting locks L and R.

We claim:

1. A yarn length control system for a flat knitting machine, wherein a plurality of yarns are fed from yarn feeding means to at least one needle bed, said at least one needle bed is provided with a plurality of knitting cam locks, each of the knitting locks has a pair of cams, said pair including an onward stitch cam and a rearward stitch cam, each knitting lock operates the needle bed to form series of stitches from the fed yarns, and respective stitch cam conditions are corrected by stitch cam adjustment data to alter stitch size, said yarn length control system comprising:

a measuring means for measuring consumption of each yarn;

a comparing means for comparing the measured consumption with standard yarn length; and an adjusting means which generates correcting data for the stitch cam adjustment data according to the results of comparison by the comparing means and corrects, by using the correcting data, at least one stitch cam of the knitting lock that operated the needle bed for the yarn of which consumption was measured, wherein said adjusting means corrects, by said correcting data, at least one stitch cam datum of one other knitting lock.

2. A yarn length control system for a flat knitting machine of claim 1 wherein at least one stitch cam, of a knitting lock which operated the needle bed and at least one stitch cam of said other knitting lock are positioned in the same direction for onward/rearward movement.

3. A yarn length control system for a flat knitting machine of claim 2 wherein the yarn length control system has a memory means for storing stitch cam adjustment data for each pair of a stitch cam and a yarn as a unit.

4. A yarn length control system for a flat knitting machine of claim 1 wherein the flat knitting machine has a single carriage and said respective knitting locks are contained in said carriage.

5. A yarn length control system for a flat knitting machine of claim 1 wherein the respective knitting locks are contained in separate carriages.

6. A yarn length control system for a flat knitting machine, wherein a plurality of yarns are fed from yarn feeding means to at least one needle bed, said at least one needle bed is provided with a plurality of knitting cam locks, each of the knitting locks has a pair of cams, said pair including an onward stitch cam and a rearward stitch cam, each knitting lock operates the needle bed to form series of stitches from the fed yarns, and the respective stitch cam conditions are corrected by stitch cam adjustment data to alter stitch size, said yarn length control system comprising:

a measuring means for measuring consumption of each yarn;

a comparing means for comparing the measured consumption with standard yarn length; and an adjusting means which generates correcting data for the stitch cam adjustment data according to the results of comparison by the comparing means and corrects, by using the correcting data, at least one stitch cam of the knitting lock that operated the needle bed for the yarn of which consumption was measured, wherein said adjusting means corrects, relative to the outer yarns, by said correcting data, said stitch cam data of the knitting lock which operated the needle bed for the yarn of which consumption was measured.

* * * * *